US011033118B2

(12) United States Patent
Fok

(10) Patent No.: US 11,033,118 B2
(45) Date of Patent: Jun. 15, 2021

(54) VERTICALLY RECIPROCATING CRADLE

(71) Applicant: Yun Ho Fok, Hong Kong (CN)

(72) Inventor: Yun Ho Fok, Hong Kong (CN)

( * ) Notice: Subject to any disclaimer, the term of this patent is extended or adjusted under 35 U.S.C. 154(b) by 0 days.

(21) Appl. No.: 16/309,140

(22) PCT Filed: Apr. 16, 2018

(86) PCT No.: PCT/CN2018/083151
§ 371 (c)(1),
(2) Date: Dec. 12, 2018

(87) PCT Pub. No.: WO2018/192431
PCT Pub. Date: Oct. 25, 2018

(65) Prior Publication Data

US 2020/0029708 A1 Jan. 30, 2020

(30) Foreign Application Priority Data

Apr. 17, 2017 (CN) ..... 201710249650.3

(51) Int. Cl.
*A47D 9/02* (2006.01)

(52) U.S. Cl.
CPC ..... *A47D 9/02* (2013.01)

(58) Field of Classification Search
CPC ..... A47D 9/02; A47D 13/105; A47D 13/107; A47D 9/04; A47C 20/021; A47C 20/043
USPC ..... 5/108
See application file for complete search history.

(56) References Cited

U.S. PATENT DOCUMENTS 2,259,534 A * 10/1941 Reynolds ..... A47C 7/282 267/81
2,663,029 A * 12/1953 Whitley ..... A47C 20/043 5/634
3,334,944 A * 8/1967 Elsner ..... A47D 13/02 297/377
3,353,196 A * 11/1967 Guillon ..... A47C 20/043 5/660
3,484,878 A * 12/1969 Nielsen ..... A47C 20/043 5/617
3,759,252 A * 9/1973 Berman ..... A61F 5/04 602/19

(Continued)

FOREIGN PATENT DOCUMENTS

CN 205181715 U * 4/2016 ..... A61G 13/12

*Primary Examiner* — Nicholas F Polito
*Assistant Examiner* — Luke Hall
(74) *Attorney, Agent, or Firm* — Luedeka Neely Group, PC

(57) ABSTRACT

A vertically reciprocating cradle includes a mattress for bearing a baby and an elastic support structure for supporting the mattress. The support structure comprises a limiting plate, a middle connector and two elastic portions. Each of the two elastic frames comprises an upper support portion and a lower limiting portion. The upper support portions of the two elastic frames are connected with the middle connector, and grooves formed on the limiting plate, and the two lower limiting portions of the frames are matched with grooves in the limiting plate. A connecting unit is formed at one end of the mattress and connected with the middle connector, and the other end of the mattress is inclined downwards. The mattress is arranged on the elastic support structure in an inclined mode, and the vertical bouncing of the elastic support structure drives the mattress to move up and down.

9 Claims, 9 Drawing Sheets

(56) References Cited

U.S. PATENT DOCUMENTS

| | | | | | |
|---|---|---|---|---|---|
| 4,561,649 | A * | 12/1985 | Forsythe | A47C 16/025 | 482/121 |
| 5,267,678 | A * | 12/1993 | Zuckerman | A47G 25/485 | 223/85 |
| 6,257,422 | B1 * | 7/2001 | Rios | A47F 7/143 | 211/45 |
| 7,551,100 | B1 * | 6/2009 | Salley | A47D 9/02 | 340/691.1 |
| 7,669,927 | B1 * | 3/2010 | Zaid | A47D 9/02 | 297/260.2 |
| 7,685,657 | B1 * | 3/2010 | Hernandez | A47D 9/02 | 5/109 |
| 7,861,337 | B1 * | 1/2011 | Patel | A47D 9/02 | 5/108 |
| 8,328,153 | B2 * | 12/2012 | Yang | F16M 11/38 | 248/370 |
| 8,898,840 | B1 * | 12/2014 | Majette | A47C 7/383 | 5/637 |
| 2004/0049853 | A1 * | 3/2004 | Lary | A47C 20/021 | 5/634 |
| 2006/0012230 | A1 * | 1/2006 | Kennedy | A47D 9/02 | 297/261.3 |
| 2010/0109398 | A1 * | 5/2010 | Moulin | A47D 13/00 | 297/217.3 |
| 2010/0123341 | A1 * | 5/2010 | Furman | B60N 2/2845 | 297/217.4 |
| 2012/0181830 | A1 * | 7/2012 | Gooris | A47D 13/107 | 297/250.1 |

* cited by examiner

VERTICALLY RECIPROCATING CRADLE

CROSS-REFERENCE TO RELATED APPLICATIONS

The present application is a Section 371 national phase entry of PCT application PCT/CN2018/083151 filed Apr. 16, 2018, which claims priority to and the benefit of Chinese Patent Application No. CN 201710249650.3 filed on Apr. 17, 2017, entitled "VERTICALLY RECIPROCATING CRADLE," the entire content of which is incorporated herein by reference.

BACKGROUND OF THE INVENTION

Field of the Invention

The application relates to the field of cradles, and more particularly, to a vertically reciprocating cradle.

Description of the Related Art

Cradles are one kind of necessities for a newborn baby, which help the baby falling asleep. The cradles are designed as an effective means to provide a rocking motion so as to improve the sleep quality of the baby.

At present, cradles mainly comprise a mattress structure for bearing the baby, and a support structure for supporting the mattress, wherein the mattress structure is horizontally positioned in the support structure, and the support structure comprises a plurality of legs for supporting the whole cradle. And an arcuate rocking bar is connected between the legs. Rocking of the cradle in the left-right direction may be achieved by the variation of the contact area between the rocking bar and the floor when the cradle is rocked by hands.

In the prior art, rocking the baby left and right will cause the baby to feel dizzy, which is not beneficial to the brain development of the baby. While due to lack of any ergonomic design, the horizontally arranged mattress structure may make baby feel uncomfortable when the baby is lying on the mattress. In addition, such a structure will cause the baby to regurgitate milk, and is not helpful for baby's falling into sleep.

SUMMARY OF THE INVENTION

The purpose of the invention is to provide a vertically reciprocating cradle, so as to solve the issue that left/right rocking the baby is not beneficial to the brain development of the baby and the baby is prone to regurgitate milk when the baby is lying on the horizontally arranged mattress. The present application provides a vertically reciprocating cradle, comprising a mattress for bearing a baby and an elastic support structure for supporting the mattress; wherein the elastic support structure comprises a limiting plate, a middle connector and two elastic frames, and wherein each of the two elastic frames comprises an upper support frame and a lower limiting frame, the upper support frames of the two elastic frames are connected with the middle connector, and a limiting unit is formed on the limiting plate, and the two elastic frames are positioned on the limiting plate, respectively, and the two lower limiting frames are matched with the limiting unit; and wherein a connecting unit is formed at one end of a lower end surface of the mattress and connected with the middle connector, and the other end of the mattress is inclined downwards.

Furthermore, the limiting plate is formed with a plurality of limiting units, and the plurality of limiting units are symmetrically distributed at opposite ends of the limiting plate, and each of the two lower limiting frames matches to each of the limiting units symmetrical at two ends as a pair.

Furthermore, the plurality of limiting units are grooves, and the grooves, distributed at the two ends of the limiting plate, are obliquely arranged toward a direction of a symmetry plane of the limiting plate, and the lower limiting frames are embedded into the grooves.

Furthermore, the middle connector comprises a connecting plate formed in the middle and two hinges respectively formed at two ends of the middle connector, and each of the two hinges is hinged to each of the two upper support frames respectively.

Furthermore, the connecting unit of the mattress is provided with a first adhesive member, and a second adhesive member is formed on the connecting plate located on the middle connector, and the first adhesive member and the second adhesive member are adhered to each other.

Furthermore, the mattress comprises a cushion, a cushion cover and a support plate, and the cushion cover comprises a first pocket portion and a second pocket portion, and wherein the sponge cushion is sleeved in the first pocket portion, the support plate is sleeved in the second pocket portion, and the second adhesive member is located on the cushion cover.

Furthermore, the cushion comprises a bearing surface for bearing the baby, and a support surface opposite to the bearing surface, and the support surface is a plane, wherein an upper convex portion and a lower convex portion are formed on the bearing surface, and the baby lies between the upper convex portion and the lower convex portion.

Furthermore, the vertically reciprocating cradle further comprises two baffles, and the two baffles are respectively hinged to two ends of a bottom plate disposed between the two baffles, wherein the bottom plate is located below the mattress, and the two baffles are located at two sides of the mattress, respectively.

Furthermore, each of the two baffles is provided with a music box.

Furthermore, the elastic frame is integrally formed by bending an elongate material.

The present invention may provide a vertically reciprocating cradle. wherein one end of the mattress is arranged on the elastic support, and the other end of the mattress is arranged on the floor or on the parents' bed, so that the mattress forms an inclined structure. The upper and lower bouncing of the elastic support will drive the mattress to move up and down together. With a proper adjustment of the inclined angle of the mattress, the mattress may make the baby feel more comfortable when lying in an inclined arrangement than lying horizontally. Since baby's head is facing upward when it is lying on the inclined mattress, milk drunk by the baby will flow down under the effect of the gravity, such that the possibility of milk regurgitation will be reduced when the baby is lying on this mattress. Compared with a left-and-right rocking mode for promoting baby's sleep, the vertical rocking mode will not make the baby feel dizzy, and thus it will be more beneficial to the brain development of the baby and meanwhile the sleep of the baby is facilitated.

BRIEF DESCRIPTION OF THE DRAWINGS

The accompanying drawings with corresponding specification, illustrate one or more exemplary embodiments of the present disclosure, and, together with the description, serve to explain the principles of the present invention. The implementation of the present invention may not limited by the exemplified embodiments. The figures have elements that have the same reference numerals presenting similar elements. Unless explicitly identified, the size and scale of the numbered elements are not limited by those shown in the drawings.

In the figures, like reference numerals are used to identify like parts throughout the figures.

Figure 1:
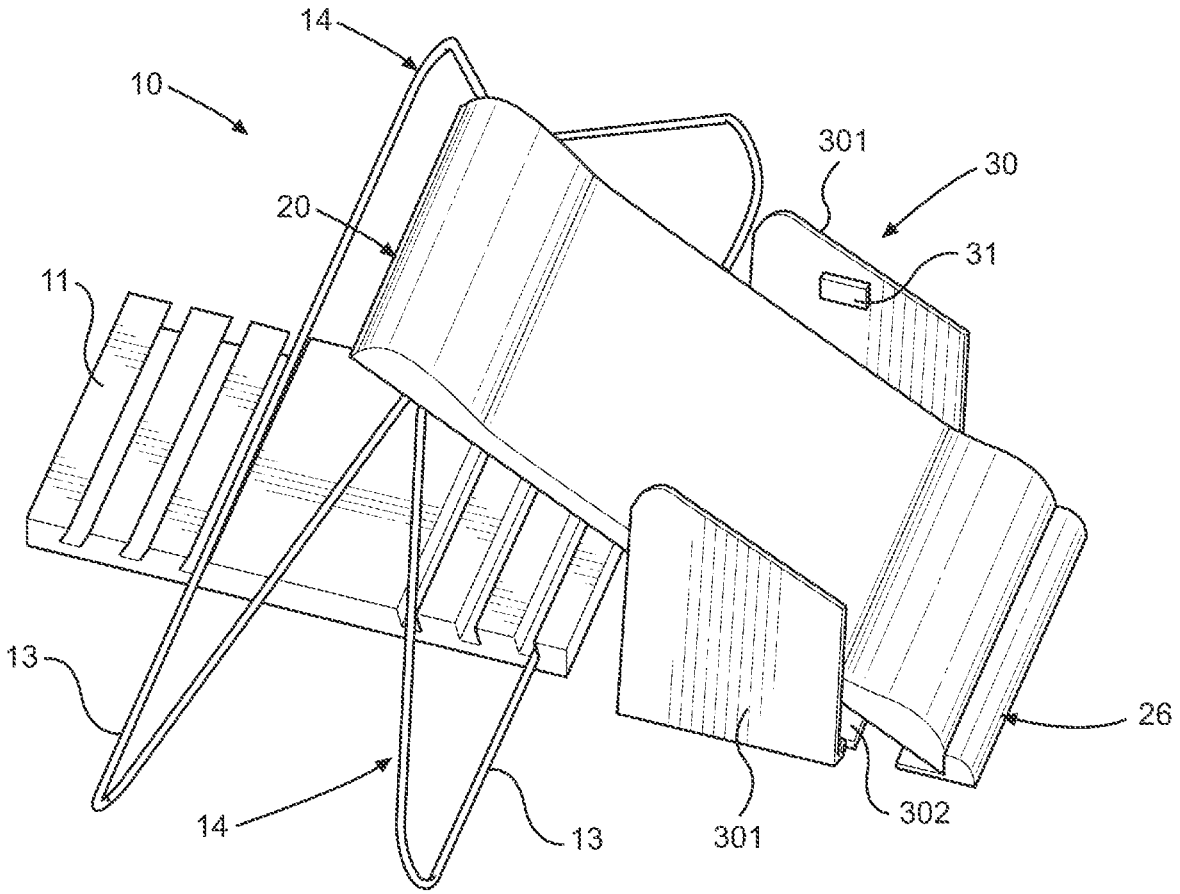
FIG. 1 is a perspective diagram of a vertically reciprocating cradle according to an embodiment of the present application.

DETAILED DESCRIPTION the present preferred embodiments of the present invention will now be described in more detail hereinafter with reference to the accompanying drawings, in which exemplary embodiments of the invention are shown. It should be understood that all descriptive embodiments herein are only used for explaining the exemplified application of this invention and should not be construed as limited to the embodiments set forth herein. Like reference numerals refer to like elements throughout.

The same or similar reference numerals in the drawings of the present embodiment correspond to the same or similar components. In the description of the present application, it is understood that the terms "up" or "upper", "down" or "lower", "left", "right", indicates the directional, orientational or positional relationships. It is merely for convenience of description of the present embodiments and simplified description. It does not indicate or imply that the device or components referred to have a specific orientation, or that must have a structure or operation in a specific orientation. Therefore, the terms used to describe the positional relationship in the drawings are for illustrative purposes only and are not to be construed as limiting the present invention. For those skilled in the art, the specific meaning of the above terms may be understood according to specific situations.

The implementation of the present application is described in detail below with reference to specific embodiments.

Figure 2:
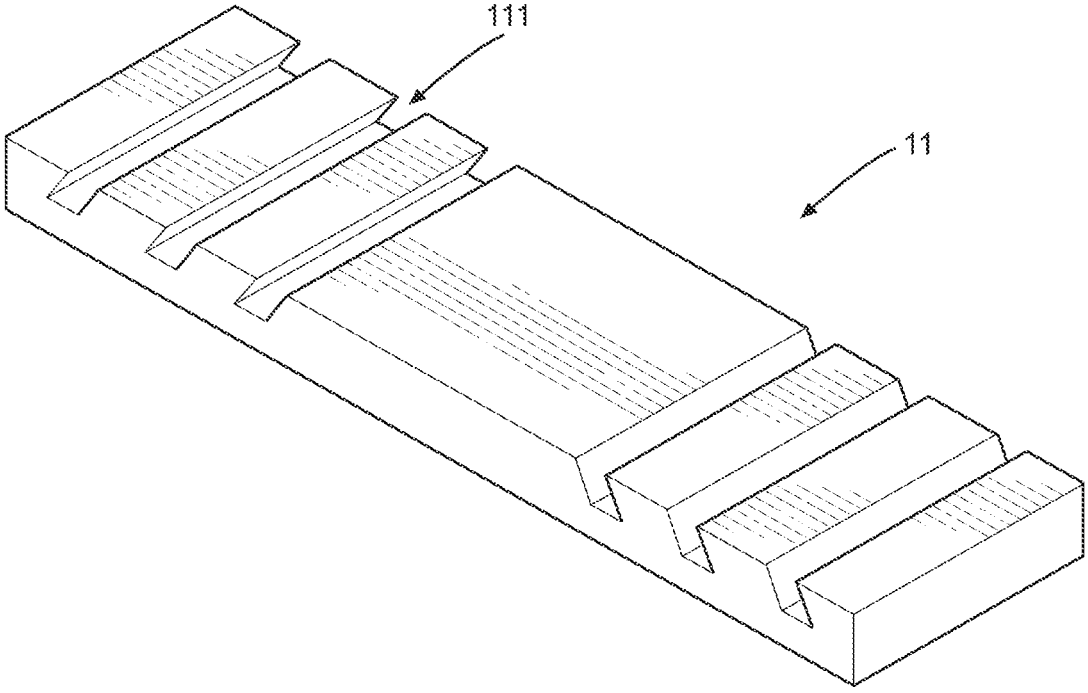
FIG. 2 is a perspective diagram of a limiting plate according to an embodiment of the present application.
Figure 3:
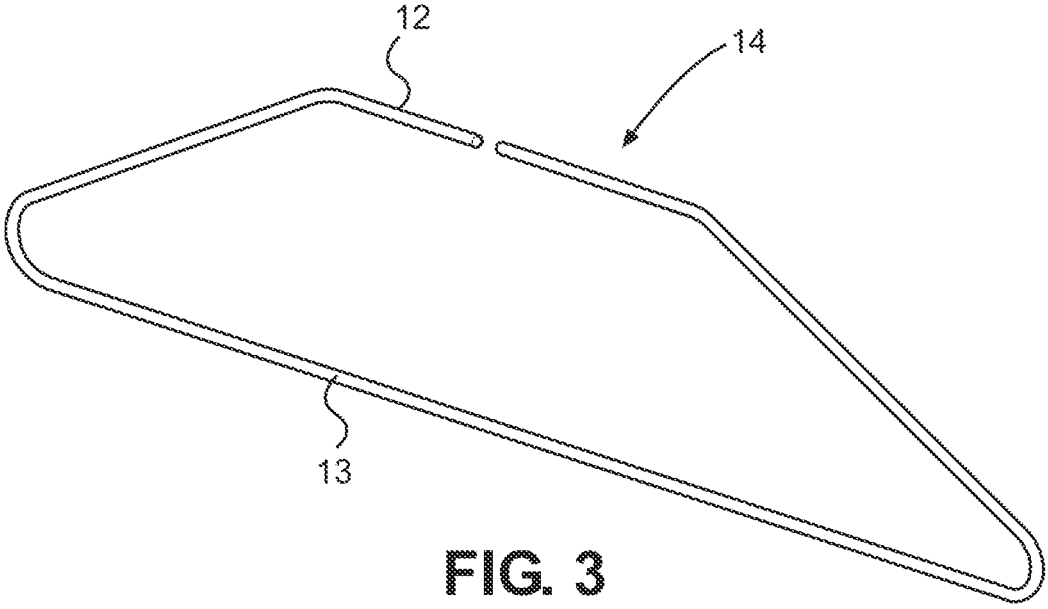
FIG. 3 is a perspective diagram of an elastic frame according to an embodiment of the present application.
Figure 4:
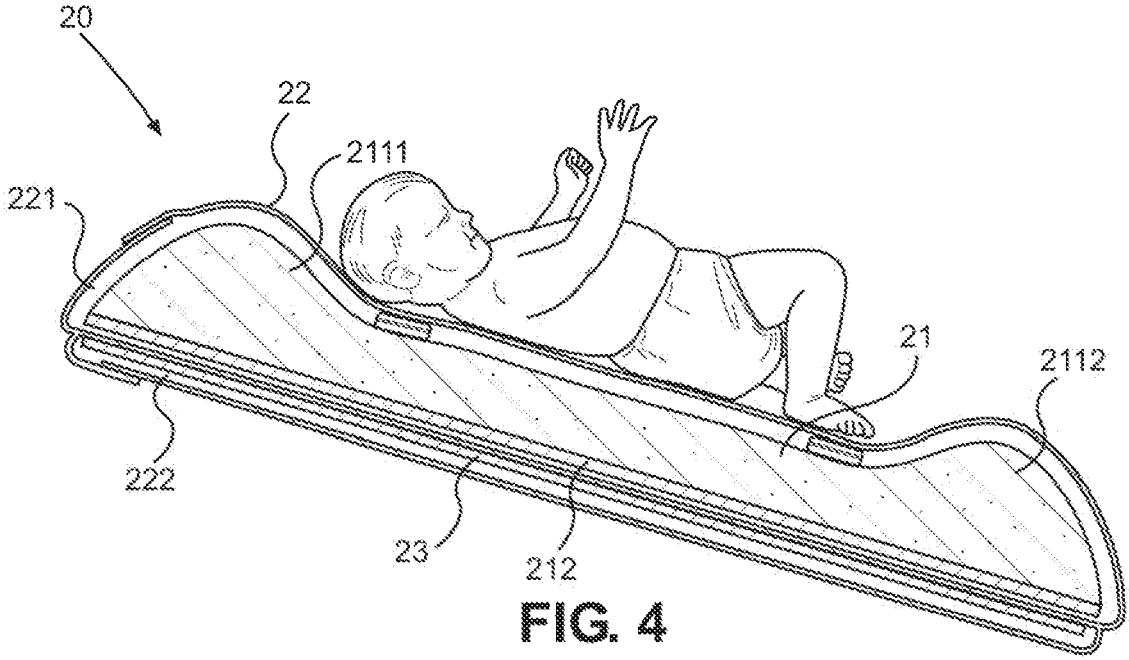
FIG. 4 is a schematic cross-sectional structural view of a mattress according to an embodiment of the present application.
Figure 5:
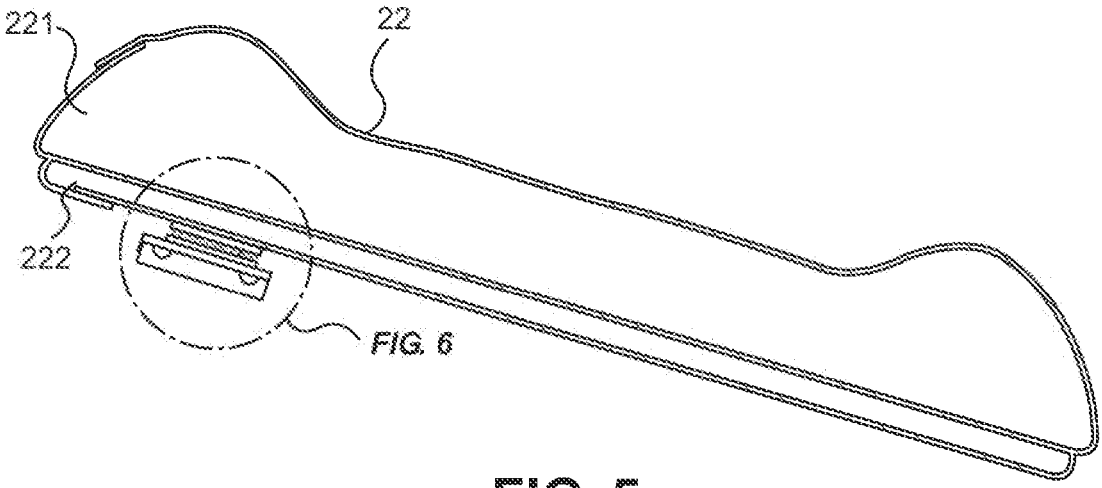
FIG. 5 is a schematic view showing the connection structure of a cushion cover and a middle connector according to an embodiment of the present application.
Figure 6:
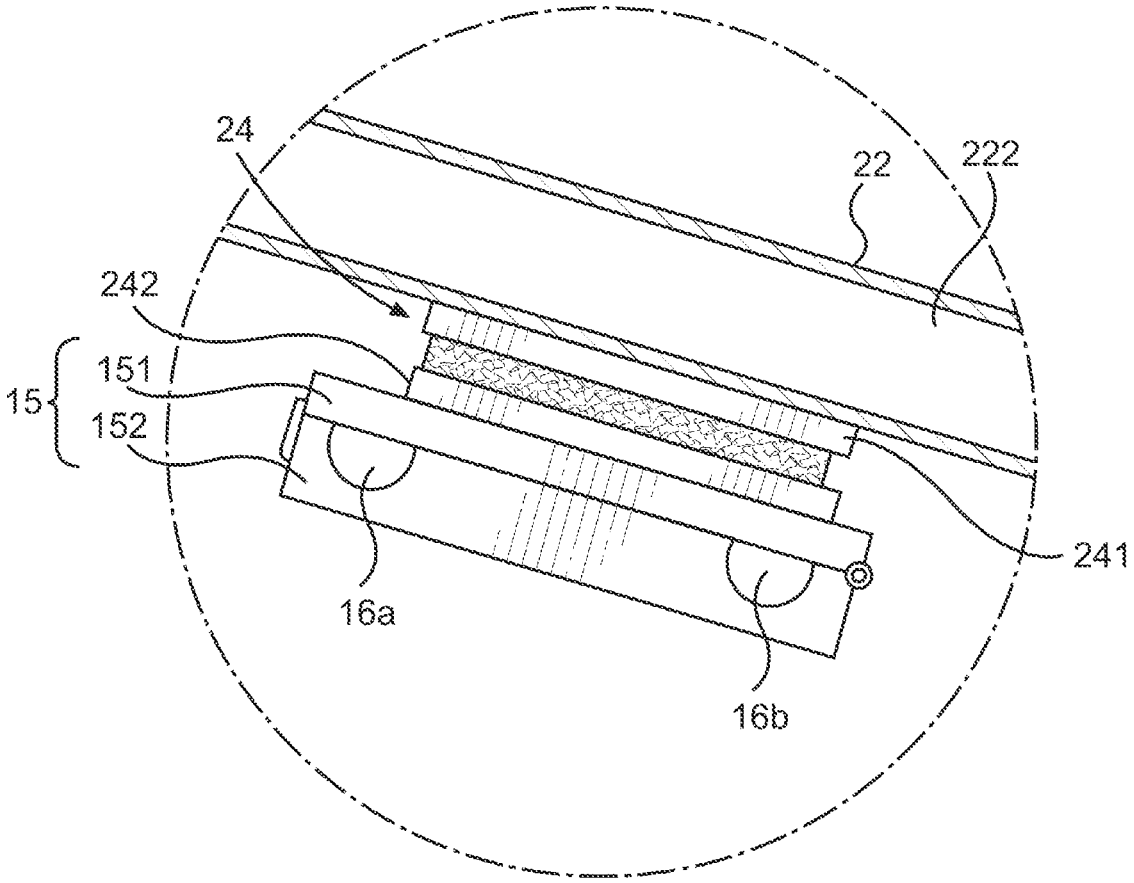
FIG. 6 is a schematic enlarged view of a structure indicated by A in FIG. 5.
Figure 7:
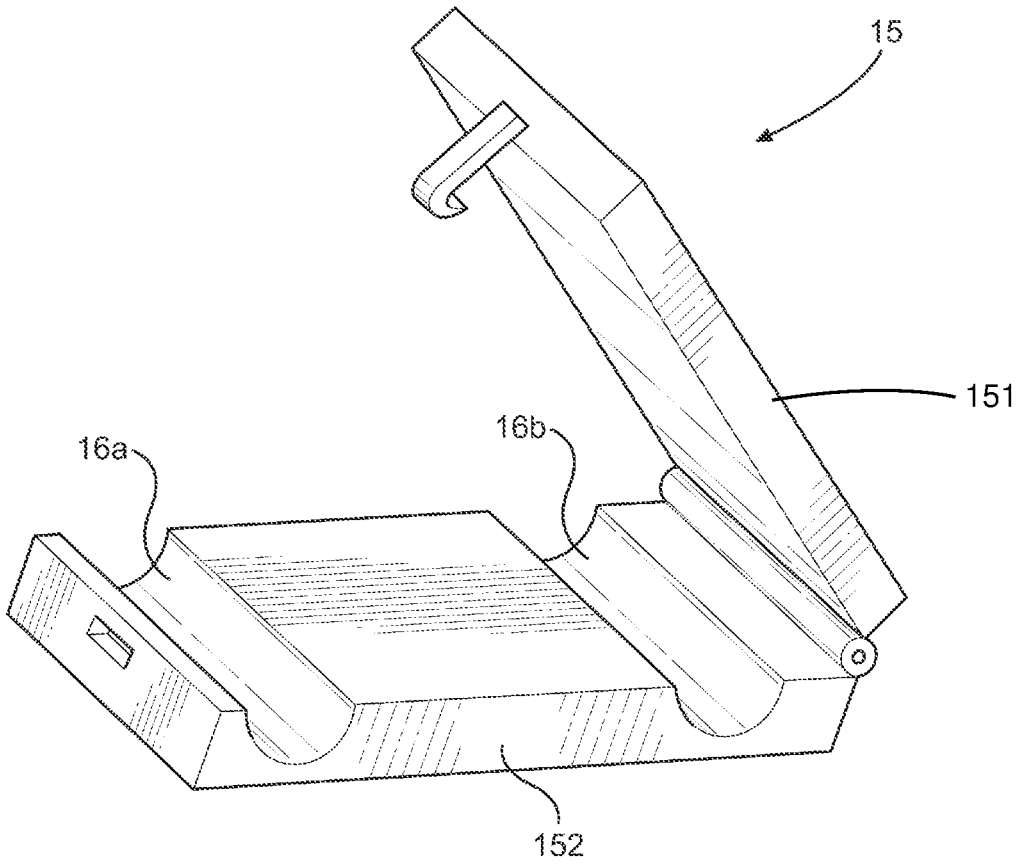
FIG. 7 is a perspective view of details of the middle connector for the cradle of FIG. 1.
Figure 8:
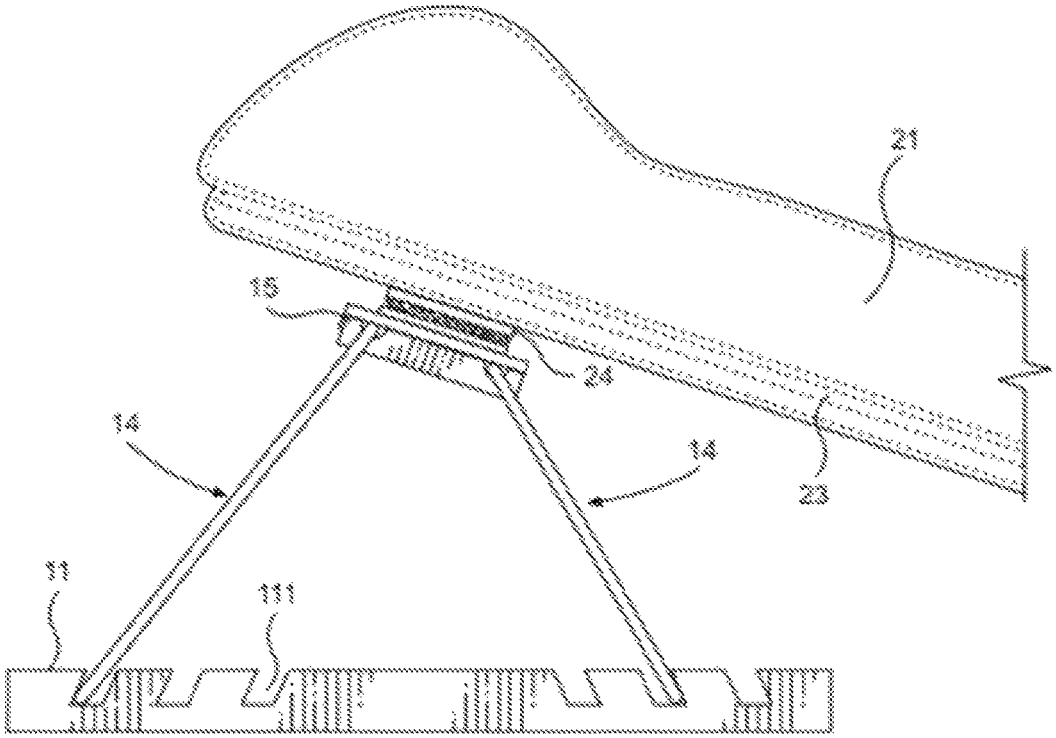
FIG. 8 is a partial side perspective view of the cradle of FIG. 1.
Figure 9:
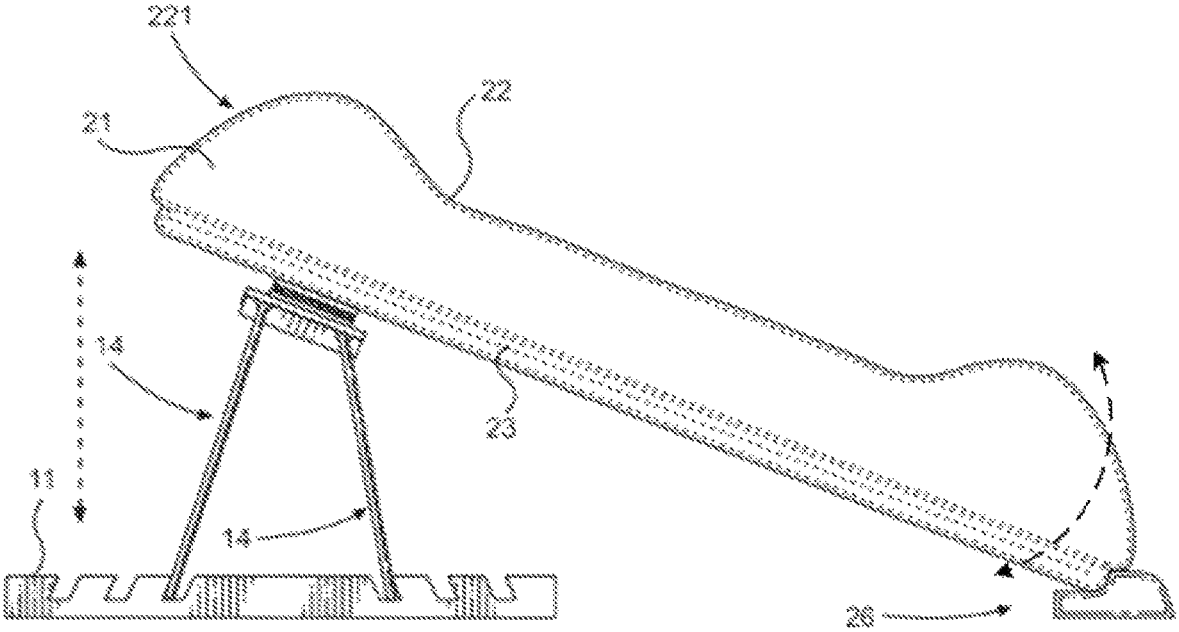
FIGS. 9-10 are side perspective view of the cradle of FIG. 1 having different height adjustments.
Figure 10:
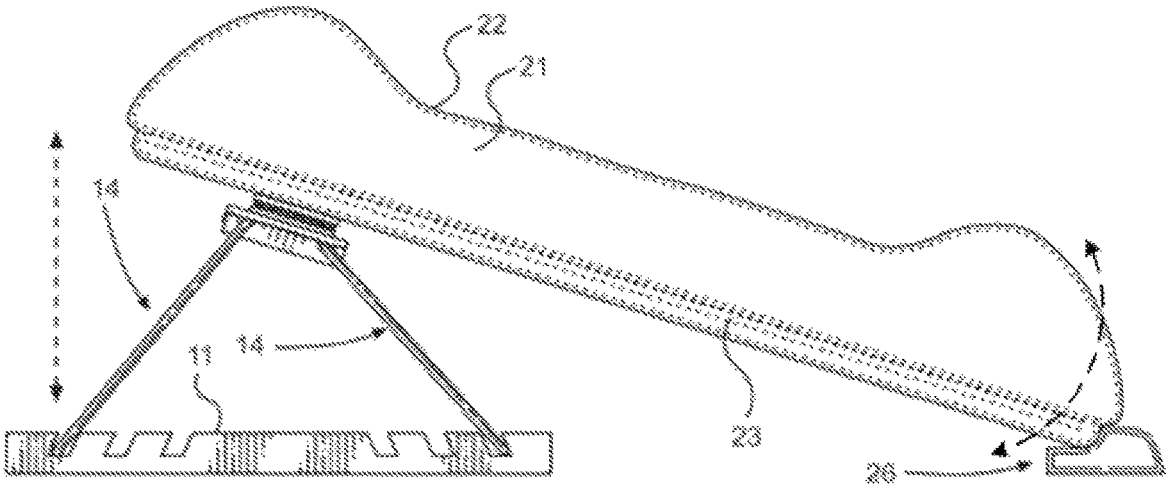
Figure 11:
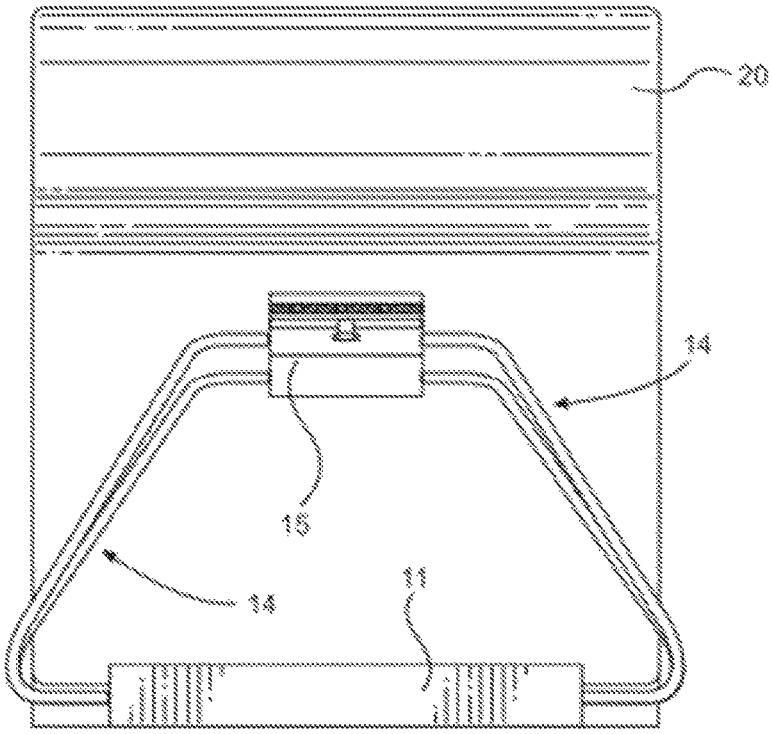
FIG. 11 is an end perspective view of the cradle of FIG. 1.
Figure 12:
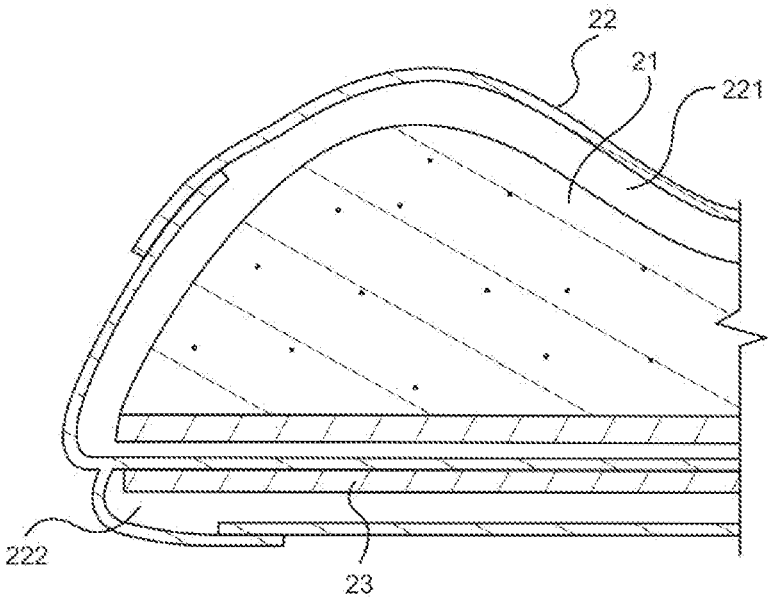
FIG. 12 is a partial side view of a cushion for the cradle of FIG. 1 showing details of the cover and support plate.
Figure 13:
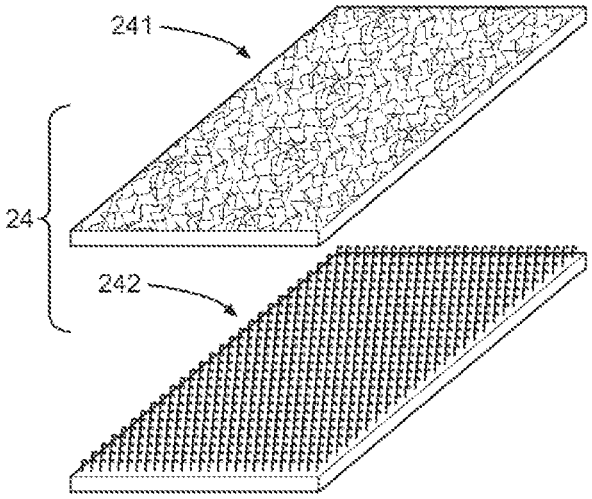
FIG. 13 is a perspective view of a connecting unit for the cradle of FIG. 1.
Figure 14:
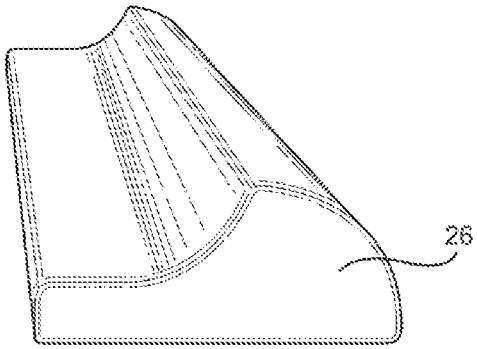
FIG. 14 is a perspective view of a platform for the cradle of FIG. 1.

A preferred embodiment of the application is shown in FIGS. 1-6.

A vertically reciprocating cradle comprises a mattress 20 for bearing a baby and an elastic support structure 10 for supporting the mattress 20, and the vertical bouncing movement of the elastic support structure 10 will drive the mattress 20 to move up and down.

The elastic support structure 10 comprises a limiting plate 11, a middle connector 15 and two elastic frames 14, and wherein each of the two elastic frames 14 comprises an upper support portion 12 and a lower limiting portion 13, the upper support portions 12 of the two elastic frames 14 are connected to the middle connector 15. In an embodiment, the connections may comprise detachable hinges 16*a* and 16*b*. The upper support portions 12 of the two elastic frames 14 may rotate freely in the hinges 16*a* and 16*b* of the middle connector 15. Grooves 111 is formed on the limiting plate 11, and the two elastic frames 14 are arranged at an angle and positioned on the limiting plate 11, and the two lower limiting portions 13 are matched with the grooves 111 respectively when the elastic frames 14 are positioned.

A connecting unit 24 is formed at a lower surface of the mattress 20 and is located on one end of the mattress 20. The connecting unit 24 is connected with the middle connector 15. The other end of the mattress 20 is located at a bottom plate 302 or on the parents' bed, or rest on or pivotally engaged with a platform 26, depending on the practical situation. After the positioning of the mattress 20, the mattress 20 is in an inclined arrangement.

A connecting unit 24 is formed at a lower end surface of the mattress 20 and is located on one end of the mattress 20. The connecting unit 24 is connected with the middle connector 15. The other end of the mattress 20 is located at a bottom plate 302 or on the parents' bed, depending on the practical situation. After the positioning of the mattress 20, the mattress 20 is in an inclined arrangement.

The present embodiment may also provide a vertically reciprocating cradle, wherein one end of the mattress 20 is arranged on the elastic support structure 10, and another end of the mattress 20 is arranged on the floor or on the parents' bed, so that the mattress 20 forms an inclined structure. The vertical bouncing movement of the elastic support structure 10 will drive the mattress 20 to rock up and down. With a proper adjustment of the inclined angle of the mattress 20, the mattress 20 may make the baby feel more comfortable when lying in an inclined arrangement than lying horizontally.

Since baby's head is facing upward when it is lying on the inclined mattress 20, milk drunk by the baby will flow down under the effect of the gravity, such that the possibility of milk regurgitation will be reduced when the baby is lying on the mattress. Compared with a left-and-right rocking mode for promoting sleep, the vertical rocking mode will not make the baby feel dizzy. Thus it will be more beneficial to the brain development of the baby and meanwhile make the baby have a sound sleep.

In this embodiment, in order to allow the adjustment of the height of the cradle to fit different sizes of the baby, the limiting plate 11 comprises a plurality of grooves 111. The plurality of grooves 111 are symmetrically disposed at opposite ends of the limiting plate 11, and each of the two lower limiting portions 13 matches with each pair of the corresponding grooves 111 at two ends. Specifically, one end of the two elastic frames 14 is connected by the middle connector 15, and then another end thereof is respectively matched with the groove 111 at both ends of the limiting plate 11. Because of a plurality of grooves 111, when the elastic frames 14 match with different grooves 111 in pair, the angle formed by the two elastic frames 14 may vary. The integrational height of the elastic support structure 10 will vary corresponding with the variation of the angle. At the same time the height of the mattress 20 located above the elastic support structure 10 will vary correspondingly as well. Accordingly, the height adjustment of the cradle can be achieved.

In other embodiments, one end of the limiting plate 11 may be provided with a limiting unit 111, which is matched with one elastic frame 14, and the other end of the limiting plate 11 is provided with a plurality of limiting units 111, which are matched with another elastic frame 14. In this way, height adjustment of the elastic support structure 10 may be achieved simply by adjusting the position of one of the elastic frames 14.

In this embodiment, the grooves distributed at the two ends of the limiting plate 11, are obliquely arranged toward a direction of a symmetry plane of the limiting plate 11. The lower limiting portions 13 of the elastic frames 14 are embedded into the grooves to position the lower limiting portions 13 itself. The plurality of grooves 111 make manufacturing process simpler. Moreover, the grooves are obliquely arranged toward a direction of a symmetry plane of the limiting plate 11, such that the lower limiting portions 13 of the elastic frames 14 may be secured more stably by means of the grooves.

In other embodiments, the plurality of limiting units 111 may also be convex teeth that protrude upward.

The middle connector 15 comprises a connecting plate 151 and hinge plate 152 formed in the middle connector 15 and two hinges 16*a* and 16*b* formed at two ends of the middle connector 15 respectively, and each of the two hinges 16*a* and 16*b* is hinged to one of the two upper support portions 12 of the elastic frames 14. The structure of the connecting plate 151 is configured such that a plane area is formed on the middle connector 15, and the plane area is used to better position the mattress 20 when connecting to the middle connector 15.

The connecting unit 24 of the mattress comprises two adhesive members. A first adhesive member 241 is attached to an upper end of the mattress. The connecting plate 151 located on the middle connector 15 comprises a second adhesive member 242. The first adhesive member 241 and the second adhesive member 242 are adhered to each other. Specifically, the adhesive members can be adhesives of being repeatedly used, and can also be a hook and loop fastener which is commonly known as a "velcro", or can be a magnetic material having a strong attraction force, etc. An advantage of using the adhesive members when positioning the mattress 20 on the middle connector 15 is that the mattress 20 can be easily detached so that the cradle can be conveniently stored and transported.

In order to achieve the effect of easy assemble and disassemble of the mattress, in this embodiment, the mattress 20 comprises a cushion 21, a cushion cover 22 and a support plate 23. The cushion cover 22 comprises a first pocket portion 221 and a second pocket portion 222, wherein the cushion 21 is sleeved in the first pocket portion 221, the support plate 23 is sleeved in the second pocket portion 222 for supporting the cushion 21 without causing bends on the sponge cushion 21. The incorporation of the cushion cover 22 allows the structure of the mattress 20 to be easily disassembled, making it more convenient to replace the mattress 20. At the meantime, the first adhesive member 241 is positioned on the cushion cover, such that the structure of the mattress 20 becomes simple. In addition, it is much easier for the replacement of the first adhesive member 241 when it is damaged.

Since the mattress 20 is arranged in an inclined configuration, the baby may slide down the mattress 20 when lying on the mattress 20. In order to solve this defect, in this embodiment, the cushion 21 comprises a bearing surface 211 for bearing the baby, and a support surface 212 opposite to the bearing surface 211. The support surface 212 is flat. The bearing surface 211 comprises an upper convex portion 2111 and a lower convex portion 2112. The baby lies between the upper convex portion 2111 and the lower convex portion 2112. That is, the bearing surface 211 of the cushion 21 forms a concave arc structure. When the baby is lying in the concave arc, the lower convex portion 2112 may support the baby to prevent the baby from sliding down. In addition, the special curve arrangement makes the baby sleep more comfortably.

In order to prevent the baby from falling off the cradle from the sides, the mattress 20 comprises two convex portions on the left and right sides, respectively. In addition, the vertically reciprocating cradle further comprises a baffle frame 30 structure. The baffle frame 30 comprises two baffles 301 and a bottom plate 302 disposed between the two baffles 301. The two baffles 301 are respectively hinged to two ends of the bottom plate 302 the bottom plate 302 is located below the mattress 20. The two baffles 301 are respectively disposed at two sides of the mattress 20. The arrangement of the baffles prevents the baby from falling off the cradle from the sides. In particular, the baffle frame 30 is independently presented, so that it is very convenient to carry. Because it can be folded, the baffle frame 30 does not require much space in terms of carrying and storage.

In order to enhance the function of putting the baby into sleep quickly, in this embodiment, each of the two baffles 301 is provided with a music box 31. Such a music box 31, on one hand, can put the baby into sleep. On the other hand, it serves as a tool for playing with the baby.

In particular, the two elastic frames 14 are integrally formed by bending an elongate material. Therefore, there will not be many nodes formed on the two elastic frames 14. In this way, the cradle will be simple and convenient, and skin injury caused by scratching of the nodes may be avoided. Moreover, the integrally formed elastic frame 14 is more convenient to process, and at the same time, the elastic effect of the elastic frame 14 can be enhanced.

Finally, it should be noted that the above embodiments are only used to illustrate the technical solutions of the present application, and that are not limited thereto. In the idea of the present application, the technical features in the above embodiments or different embodiments may also be combined. The combination of steps may be carried out in any order, and there are many other variations of the various aspects of the present application as described above, which are not provided in the details for the simplicity. Although the present application has been described in details with reference to the foregoing embodiments, it should be understood by those skilled in the art that the technical solutions described in the foregoing embodiments may be modified or equivalently substituted for some of the technical features. The modifications or substitutions do not deviate from the scope of the embodiments of the present application.

What is claimed is:

1. A vertically reciprocating cradle, comprising: a mattress for bearing a baby and an elastic support structure for supporting the mattress;

wherein the elastic support structure comprises a limiting plate, a connecting unit, a middle connector and two elastic frames, and wherein each of the two elastic frames comprises an upper support portion and a lower limiting portion, the upper support portion of each of the two elastic frames is connected with the middle connector, and grooves are provided in the limiting plate, and the two elastic frames are positioned on the limiting plate, respectively, and the lower limiting portion of each of the two elastic frames is inserted in the grooves in the limiting plate; and wherein the other end of the mattress is inclined downward, wherein the connecting unit comprises two adhesive members, and the middle connector comprises a connecting plate and a hinge plate containing two hinges therein, and each hinge of the two hinges is hinged to the upper support portion of one of the two elastic frames, and wherein a first adhesive member is positioned on an upper end of the mattress, and a second adhesive member is positioned on the connecting plate, wherein the first adhesive member and the second adhesive member are configured to adhere to each other.

2. The vertically reciprocating cradle according to claim 1, wherein the limiting plate comprises a plurality of grooves, and the plurality of grooves are symmetrically distributed at opposite ends of the limiting plate, and the lower limiting portions of the two elastic frames are disposed in two of the plurality of grooves.

3. The vertically reciprocating cradle according to claim 2, wherein the grooves are obliquely arranged toward a direction of a symmetry plane of the limiting plate, and the lower limiting portions of the two elastic frames are configured to be coupled with the grooves.

4. The vertically reciprocating cradle according to claim 1, wherein the mattress comprises a cushion, a cushion cover and a support plate, and the cushion cover comprises a first pocket portion and a second pocket portion, and wherein the cushion is configured to be sleeved in the first pocket portion, the support plate is configured to be sleeved in the second pocket portion.

5. The vertically reciprocating cradle according to claim 4, wherein the cushion comprises a bearing surface for bearing the baby, and a support surface opposite to the bearing surface, the support surface is flat, wherein the bearing surface comprises an upper convex portion and a lower convex portion, wherein the upper convex portion and the lower convex portion are configured to receive a baby therebetween.

6. The vertically reciprocating cradle according to claim 1, wherein the vertically reciprocating cradle further comprises a baffle frame, and the baffle frame comprises two baffles, and the two baffles are respectively hinged to two ends of a bottom plate disposed between the two baffles, the bottom plate is disposed below the mattress, and the two baffles are disposed at two sides of the mattress respectively.

7. The vertically reciprocating cradle according to claim 6, wherein each of the two baffles comprises a music box.

8. The vertically reciprocating cradle according to claim 1, wherein each of the two elastic frames comprises a single bent piece of elongate material.

9. The vertically reciprocating cradle according to claim 1, wherein the other end of the mattress is resting on or pivotally engaging on a platform.

* * * * *